US010974877B2

(12) United States Patent
Kim et al.

(10) Patent No.: US 10,974,877 B2
(45) Date of Patent: Apr. 13, 2021

(54) LIQUID CONTENTS DISCHARGE CONTAINER

(71) Applicant: YONWOO CO., LTD, Incheon (KR)

(72) Inventors: Hak-Chan Kim, Incheon (KR); Young-Moo Bae, Incheon (KR); Sang-Hun Lee, Incheon (KR); Jae-Ock Lee, Incheon (KR)

(73) Assignee: YONWOO CO., LTD, Incheon (KR)

( * ) Notice: Subject to any disclaimer, the term of this patent is extended or adjusted under 35 U.S.C. 154(b) by 0 days.

(21) Appl. No.: 16/767,274

(22) PCT Filed: Oct. 25, 2018

(86) PCT No.: PCT/KR2018/012698
§ 371 (c)(1),
(2) Date: May 27, 2020

(87) PCT Pub. No.: WO2019/107749
PCT Pub. Date: Jun. 6, 2019

(65) Prior Publication Data

US 2020/0324944 A1 Oct. 15, 2020

(30) Foreign Application Priority Data

Nov. 30, 2017 (KR) ..... 10-2017-0162392

(51) Int. Cl.
*B65D 47/18* (2006.01)
*A45D 34/00* (2006.01)

(52) U.S. Cl.
CPC ..... *B65D 47/18* (2013.01); *A45D 34/00* (2013.01)

(58) Field of Classification Search
CPC ..... B65D 47/18; A45D 34/00
USPC ..... 222/212
See application file for complete search history.

(56) References Cited

U.S. PATENT DOCUMENTS 4,250,632 A 2/1981 Botkins et al.
4,705,181 A * 11/1987 Burke ..... B65D 50/041 215/213
10,723,526 B1 * 7/2020 Aboabdo ..... B65D 47/06
10,744,519 B1 * 8/2020 Lim ..... B65D 83/0094
(Continued)

FOREIGN PATENT DOCUMENTS

EP 1002737 A1 5/2000
JP 61-137554 U 8/1986
(Continued)

*Primary Examiner* — Jeremy Carroll
(74) *Attorney, Agent, or Firm* — John K. Park; Park Law Firm

(57) ABSTRACT

The present invention relates to a tube-type cosmetic container for discharging liquid contents in a droplet form, the container having a sealing member, which is coupled to the inside of an overcap and has a sealing protrusion for closing a discharge hole of a contents discharge tube, and pulling a sealing cap downward by the tensioning of an elastic supporting body so as to maintain a state in which the sealing protrusion further comes in close contact with the inner wall of the content discharge tube, when the overcap rotates such that the sealing member is coupled to a discharge part, thereby enabling the leakage of contents to be efficiently prevented regardless of an injection deviation and an assembly deviation between components.

6 Claims, 8 Drawing Sheets

(56) References Cited

U.S. PATENT DOCUMENTS

| | | | | |
|---|---|---|---|---|
| 2005/0274744 | A1* | 12/2005 | Spada | A61F 9/0026<br>222/240 |
| 2008/0209857 | A1* | 9/2008 | Morini | B65D 47/18<br>53/281 |
| 2010/0145287 | A1* | 6/2010 | Grevin | A61F 9/0008<br>604/295 |
| 2010/0147899 | A1* | 6/2010 | Nardi | B65D 47/18<br>222/420 |
| 2011/0297703 | A1* | 12/2011 | Wilson | B65D 47/18<br>222/212 |
| 2016/0272381 | A1* | 9/2016 | Kim | A45D 34/00 |

FOREIGN PATENT DOCUMENTS

| | | | |
|---|---|---|---|
| JP | 2011-073718 | A | 4/2011 |
| KR | 10-2015-0067412 | A | 6/2015 |

* cited by examiner

LIQUID CONTENTS DISCHARGE CONTAINER

TECHNICAL FIELD

The present disclosure relates to a liquid contents discharge container, and more particularly, to a liquid contents discharge container having a sealing member which is coupled to the inside of an overcap and has a sealing protrusion for closing a discharge hole of a contents discharge tube, and pulling a sealing cap downward by the tensioning of elastic support bodies so as to maintain a state in which the sealing protrusion further gets in closely contacted to the inner wall of the contents discharge tube, when the overcap rotates such that the sealing member is coupled to a discharge part, thereby enabling the leakage of contents to be efficiently prevented regardless of an injection deviation and an assembly deviation between components.

BACKGROUND ART

Generally, liquid medicine and artificial tears which are dripped in the eyes for use are contained in a tube-type container and are provided. When a user pressurizes the tube-type container, liquid contents are uniformly discharged in a form of droplet.

As described above, a tube-type cosmetic container for discharging liquid contents in a form of droplet is disclosed in Korean Utility Model No. 20-0310084 (hereinafter, referred to as the Patent Document 1).

The Patent Document 1 is configured in a way that a tube-type cosmetic container in which a discharge part 2 formed on the front end of a tube container 1 is coupled to a discharge part coupling cap 3 with a discharge hole 3*a* being formed and a cover 4 is coupled to thereon, wherein a first discharge tube 5 in which a discharge hole 5*a* is formed is inserted into the discharge part coupling cap 3, and an intermediate outlet tube 6 having a straight line cutout 6*a* formed at an upper portion thereof and made of a rubber material is inserted into the first discharge tube 5; at an inner side of the intermediate outlet tube 6 a flange 7*b* is formed at a lower portion so as to be caught by a round jaw 2*a* formed in the discharge part 2 of the tube container 1, and at a center thereof a tube frame type outlet tube 7 having a discharge hole 7*c* communicating with in the tube container 1 is inserted.

In the Patent Document 1, when the tube container 1 is pressurized by a certain force, contents inside the container move through the discharge hole 7*c* of the tube frame type outlet tube 7 and collect in a space 9. At the same time, the cutout 6*a* of the intermediate outlet tube 6 surrounding the tube frame type outlet tube 7 spreads out, and thus a straight-line gap is generated. In this case, liquid contents collected in the space 9 are converted into a form of droplet while being discharged through the discharge hole 5*a* of the first discharge tube 5 to the outside. However, since the structure of Patent Document 1 for discharging contents in a form of droplet is complicated, the manufacturing time and cost increase, thereby causing a cost burden of a user.

"A tube-type cosmetic container for discharging liquid contents in a form of droplet" for solving the above problems is disclosed in Korean Utility Model No. 10-1554189 (hereinafter, referred to as the Patent Document 2).

Since the Patent Document 2 is capable of discharging liquid contents in a form of droplet through a simple contents discharging structure that becomes gradually wider from a lower portion to an upper portion thereof, thereby reducing user's cost burden in accordance with shortening of the manufacturing time and reducing the manufacturing cost.

However, the patent document 2 is a method in which a contents discharge tube is assembled to a tube neck, and an injection deviation and an assembly deviation may occur such that a space is generated between a discharge hole of the contents discharge tube and a closing rod of an overcap, resulting in leakage of contents.

In addition, as the contents discharge tube is made of hard materials such as hard plastic and glass, if used continuously, there is a problem in that the leakage of the contents occurs when the sealing cap of the overcap is broken and thus sealing function is deteriorated.

SUMMARY OF THE INVENTION

The present embodiments are devised to solve such problems described in the above, and the objective thereof is to provide a liquid contents discharge container configured in a way that at an inner side of an overcap a sealing member provided with a sealing protrusion for closing a discharge hole of a contents discharge tube is coupled, and when the overcap rotates such that the sealing member is coupled to a discharge part the sealing protrusion further gets closely contacted to the inner wall of the contents discharge tube so as to maintain the closely contacted state by pulling a sealing cap downward by the tensioning of elastic support bodies, thereby enabling the leakage of contents to be efficiently prevented regardless of an injection deviation and an assembly deviation between components.

To solve the above problem, a liquid contents discharge container according to an exemplary embodiment of the present disclosure may include: a container body storing contents; a container neck disposed at an upper portion of the container body and having a discharge part for discharging contents stored in the container body; a contents discharge tube coupled to an upper portion of the discharge part and having a discharge hole formed therein for discharging contents to the outside; a sealing member encasing the contents discharge tube and detachably coupled to the discharge tube, and the sealing member including a sealing cap provided with a sealing protrusion for sealing the discharge hole of the contents discharge tube when being coupled to the discharge part; and an overcap coupled, encasing the sealing member to rotate the sealing member by a user's operation.

Furthermore, it is characterized in that the sealing member may further include: a coupling part coupled to the overcap to rotate the sealing member together with rotation of the overcap; a coupling tube extending upward from a central portion of the coupling part and screwed to the discharge part; and a plurality of elastic support bodies which are extended in a spaced apart at regular intervals from an upper portion of the coupling tube, and elastically support the sealing cap.

Furthermore, it is characterized to be configured in a way that an angle of the sealing cap is changed by the tensioning of the elastic support bodies when coupling the sealing member to the discharge part by rotating the overcap, and the sealing protrusion is flexibly inserted into the discharge hole of the contents discharge tube.

Furthermore, it is characterized to be configured in a way that the sealing protrusion gets in closely contacted to the inner wall of the contents discharge tube by pulling the sealing cap downward by the tensioning of the elastic support bodies in a state inserted into the discharge hole of the contents discharge tube, thereby providing a sealing function.

Furthermore, it is characterized in that at an outer circumferential surface of the coupling part is provided with a guide protrusion to guide coupling to the overcap, and at an inner circumferential surface of the overcap is provided with a coupling groove coupled to the guide protrusion.

Furthermore, it is characterized in that at the outer circumferential surface of the coupling part is provided with a detachment prevention protrusion to prevent the detachment of the overcap due to movement thereof in an upward direction, and at the inner circumferential surface of the overcap is provided with a support protrusion supported by a lower end of the detachment prevention protrusion.

Furthermore, it is characterized to further include a discharge amount adjustment part which is coupled to the inner side of the discharge part and provided with a discharge amount adjustment tube that becomes wider from a lower portion to an upper portion thereof so that the discharge amount is adjusted when the contents discharged through the discharge part move to the upper portion thereof.

As described in the above, the present disclosure is configured in a way that at an inner side of the overcap a sealing member provided with a sealing protrusion for closing a discharge hole of a contents discharge tube is coupled, and when the overcap rotates such that the sealing member is coupled to a discharge part the sealing protrusion further gets closely contacted to an inner wall of the contents discharge tube to maintain closely contacted state by pulling a sealing cap downward by the tensioning of elastic support bodies, such that it has the advantage of efficiently preventing leakage of contents regardless of an injection deviation and an assembly deviation between parts.

DETAILED DESCRIPTION OF PREFERRED EMBODIMENTS

Figure 1:
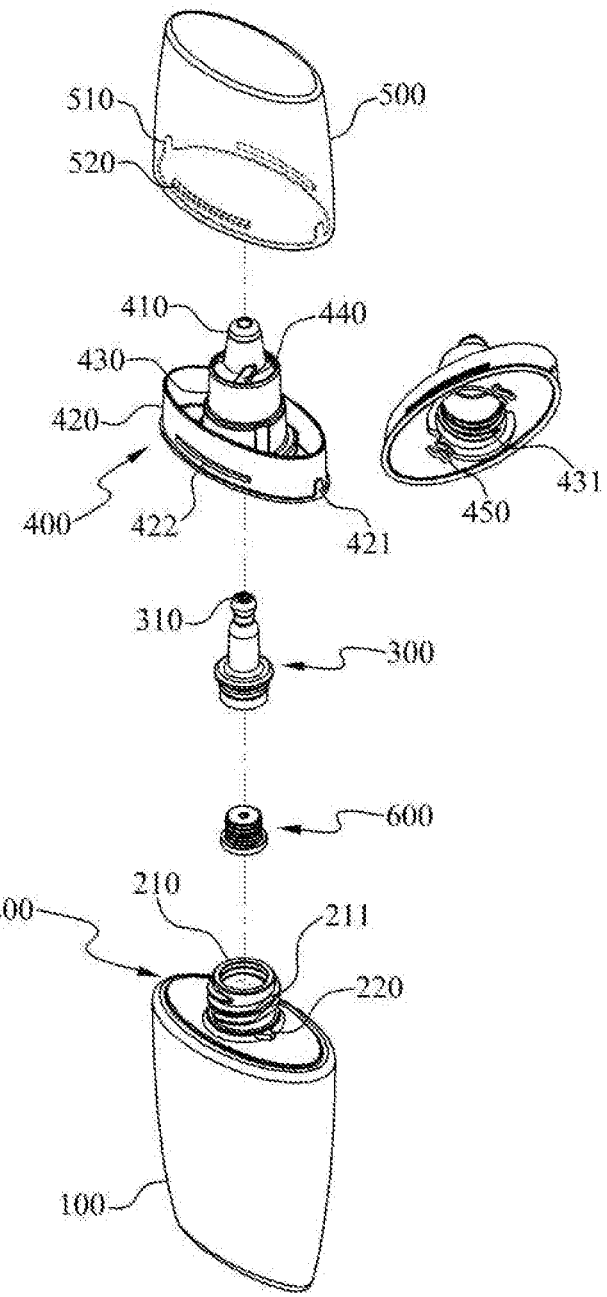
FIG. 1 is an exploded perspective view illustrating a configuration of a liquid contents discharge container according to an exemplary embodiment of the present disclosure.

Hereinafter, exemplary embodiments will be described in detail with reference to the accompanying drawings. The same reference numerals provided in the drawings indicate the same members.

FIG. 1 is an exploded perspective view illustrating a configuration of a liquid contents discharging container according to an exemplary embodiment of the present disclosure.

Figure 2:
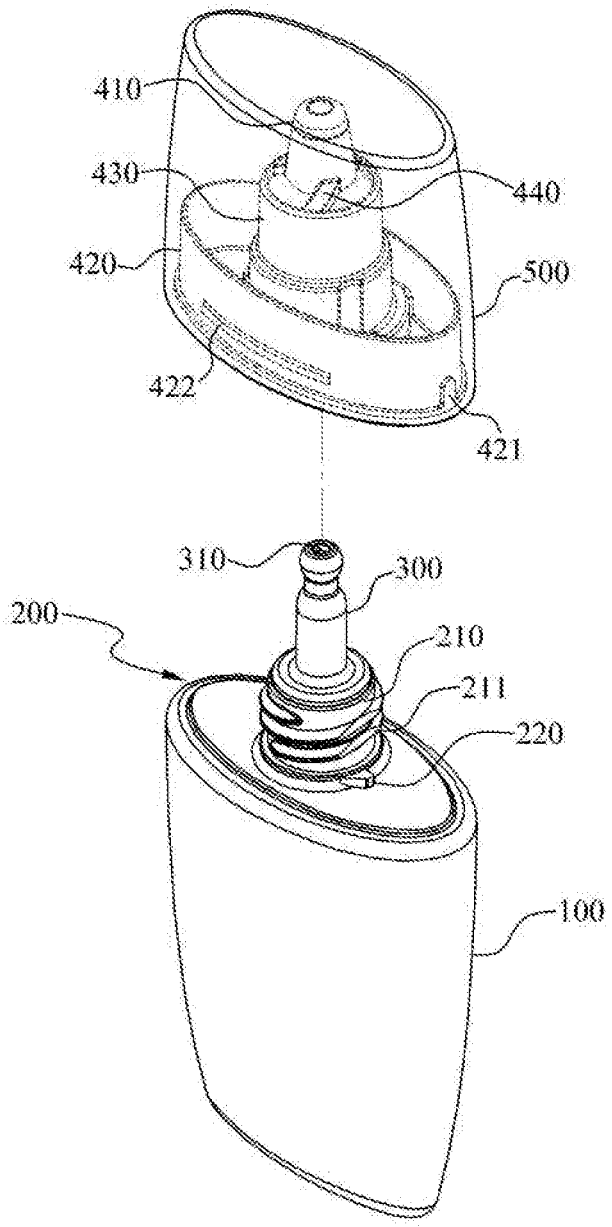
FIG. 2 is an assembled perspective view illustrating a configuration of a liquid contents discharge container according to an exemplary embodiment of the present disclosure.

FIG. 2 is an assembled perspective view illustrating a configuration of a liquid contents discharging container according to an exemplary embodiment of the present disclosure.

Figure 3:
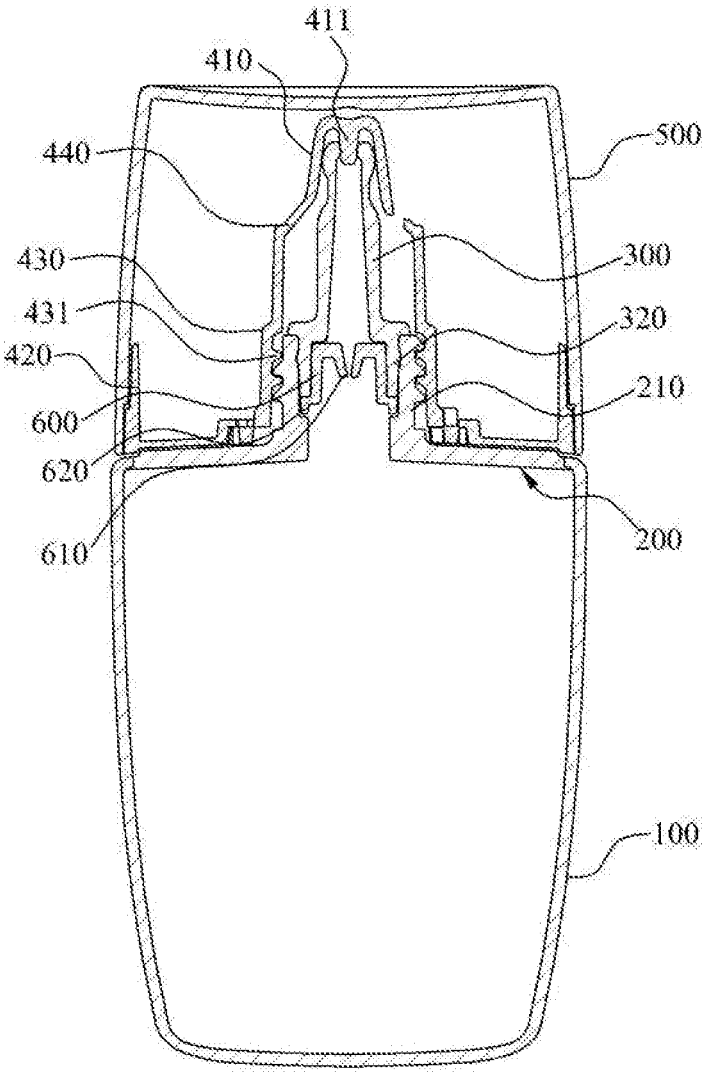
FIG. 3 is an assembled cross-sectional view illustrating a configuration of a liquid contents discharge container according to an exemplary embodiment of the present disclosure.

FIG. 3 is an assembled cross-sectional view illustrating a configuration of a liquid contents discharge container according to an exemplary embodiment of the present disclosure.

Figure 4:
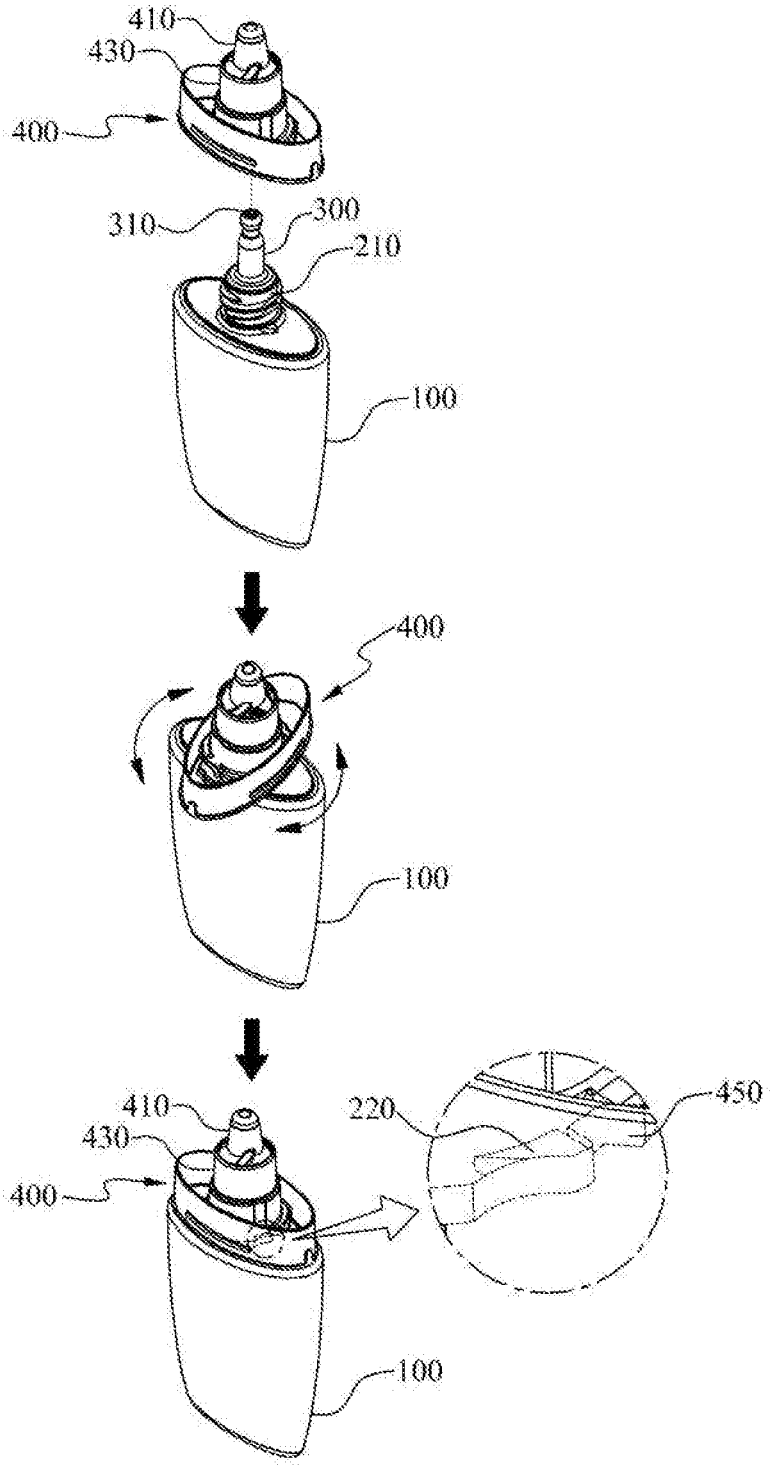
FIG. 4 is an explanatory drawing illustrating a process in which a sealing member of a liquid contents discharge container according to an exemplary embodiment of the present disclosure is coupled to a discharge part.

FIG. 4 is an explanatory drawing illustrating a process in which a sealing member of a liquid contents discharge container according to an exemplary embodiment of the present disclosure is coupled to the discharge part.

FIGS. 5 to 8 are explanatory drawings illustrating a process of sealing a discharge hole of a liquid contents discharge container according to an exemplary embodiment of the present disclosure.

Referring to FIGS. 1 to 8, a liquid contents discharge container according to an exemplary embodiment of the present disclosure includes a container body 100, a container neck 200, a contents discharge tube 300, a sealing member 400, and an overcap 500.

The container body 100, storing liquid contents, is deformed according to a user's pressurization and is made of a soft tube material so that the contents can be discharged by internal pressure of thereof.

The container neck 200 is disposed at an upper portion of the container body 100 to support the container body 100, and at a central portion thereof a discharge part 210 is formed to enable the contents stored in the container body 100 to be discharged, and at an outer circumferential surface of the discharge part 210 is formed a first screw thread 211 so that the sealing member 400 can be screw-coupled.

Furthermore, it is preferable that at a lower portion of the discharge part 210 a stopper 220 for restricting the rotation of the sealing member 400 is provided when the sealing member 400 is screw-coupled.

Meanwhile, at an inner side of the discharge part 210 is provided with a discharge amount adjustment part 600 for adjusting a discharge amount when a contents discharged through the discharge part 210 moves upward, and in the present disclosure, at a central portion of the discharge amount adjustment part 600 is provided with a discharge amount adjustment tube which becomes gradually wider from a lower portion to an upper portion.

The discharge amount adjustment tube 610 extends downward from an upper central portion of the discharge amount adjustment part 600 to control the discharge amount of the contents, and is formed to become wider from the lower portion to the upper portion, thereby allowing the contents to fall in the form of droplet.

The process of the contents falling in the form of droplet is as follows. When a user pressurizes the container body 100 in a state where the container body 100 is turned over, among the contents discharged through the discharge part 210 a very small amount of contents passes through a narrow lower portion of the discharge amount adjustment tube 610, and filling is performed inside the contents discharge tube 300. When a certain amount of contents continuously passes through the narrow lower portion of the discharge amount adjustment tube 610 in a state in which the contents are filled in the contents discharge tube 300, the contents are formed in the discharge hole 310 of the contents discharge tube 300, and then the contents are discharged in the form of droplet.

It is preferable that at a discharge amount adjustment part 600 the seating jaw 620 is formed, encasing the outer circumferential surface such that the seating protrusion 320 formed in a lower portion of the content discharge tube 300 is seated.

In the present disclosure, it has been described that the discharge amount adjustment part 600 is coupled to the inner side of the discharge part 210, but a means for adjusting the discharge amount may be provided at a center portion of the discharge part 210, and it may be implemented in various embodiments, such as a means for adjusting the discharge amount provided at the inner side of the contents discharge tube 300.

Meanwhile, depending on a viscosity of the contents stored in the container body 100, it is also possible that the contents are discharged in the form of droplet even if the discharge amount adjustment part 600 is not provided.

The contents discharge tube 300 is coupled to an upper portion of the discharge part 210 to discharge the contents to the outside, and a discharge hole 310 is formed at the upper end, thereby enabling the contents to be discharged in the form of droplet.

The contents discharge tube 300 is configured to pressurize the seating jaw 620 of the discharge amount adjustment part 600, thereby fixing the discharge control part 600 inner side of the discharge part 210, and for this purpose, a seating protrusion 320 seated on the seating jaw 620 is formed at the lower side of the contents discharge tube 300.

The sealing member 400 encases the contents discharge tube 300 and is detachably coupled to the discharge part 210, thereby opening and closing the discharge hole 310 of the contents discharge tube 300, and includes a sealing cap 410, a coupling part 420, a coupling tube 430, and a plurality of elastic support bodies 440.

The sealing cap 410 is to seal the discharge hole 310 of the contents discharge tube 300 in the process in which the sealing member 400 is coupled to the discharge part 210, and for this purpose, a sealing protrusion 411 inserted into the discharge hole 310 is provided at an inner upper portion of the sealing cap 410.

When coupling the sealing member 400 to the discharge part 210 of the container neck 200 by rotating the overcap 500, a lower portion of the sealing protrusion 411 gets closely contacted to the upper end of the contents discharge tube 300, and the sealing cap is inserted into the discharge hole 310. In the present disclosure, the sealing protrusion 411 gets closely contacted to the inner wall of the contents discharge tube 300 by the tensioning of the elastic support bodies 440 in a state inserted into the discharge hole 310 of the contents discharge tube 300, and thereby, providing an efficient sealing function.

Meanwhile, when a lower portion of the sealing projection 411 is contacted to the upper end of the contents discharge tube 300 the sealing cap 410 is characterized in that the lower portion of the sealing projection 411 is configured such that an angle is slightly changed by the tensioning of the elastic support bodies 440, and due to this, as the angle of the sealing projection 411 is changed together, even if the sealing protrusion 411 is not disposed directly above the discharge hole 310 according to the injection deviation or the assembly deviation of the contents discharge tube 300 and the sealing protrusion 411, thereby enabling the sealing protrusion 411 to be flexibly inserted into the discharge hole 310 of the contents discharge tube 300.

Furthermore, the sealing cap 410 is configured to be flexibly inserted into the discharge hole 310 while the angle of the sealing protrusion 411 is changed, and minimizes friction with the content discharge tube 300 made of a rigid material such as hard plastic or glass, thereby preventing the damage of the sealing protrusion 411 to provide an efficient sealing function even in continuous use.

The coupling part 420 is coupled to the overcap 500, thereby rotating the sealing member 400 together with rotation of the overcap 500 according to a user's manipulation, and at the outer circumferential surface of the coupling part 420 a guide protrusion 421 coupled to the coupling groove 510 of the overcap 500 is provided to guide the coupling to the overcap 500.

Furthermore, at an outer circumferential surface of the coupling part 420 the detachment prevention protrusion 422 supporting the upper end of the support protrusion 520 of the overcap 500 to prevent the overcap 500 from being moved upward and detached from the coupled state is provided.

The coupling tube 430 extends upward from a central portion of the coupling part 420 and is screw-coupled to the discharge part 210, and the second screw thread 431 is formed at its inner circumferential surface such that it can be screw-coupled to the first screw thread 211 of the discharge part 210.

The elastic support bodies 440 are extended in a spaced apart at regular intervals from an upper portion of the coupling tube 430, thereby elastically supporting the sealing cap 410, and in a state in which the sealing protrusion 411 is inserted into the discharge hole 310 of the contents discharge tube 300, a force for pulling the sealing cap 410 downward by a self-tensioning is generated, due to this, the sealing projection 411 can be more closely contacted to the inner wall of the contents discharge tube 300, such that the efficient sealing function is possible irrespective of the injection deviation or the assembly deviation of the contents discharge tube 300 and the sealing projection 411.

Furthermore, when the sealing projection 411 is inserted into the discharge hole 310, the elastic support bodies 440 slightly changes an angle of the sealing cap 410 by its own tensioning, such that the sealing protrusion 411 enables flexible insertion into the discharge hole 310 of the contents discharge tube.

Meanwhile, as shown in FIG. 4, on the bottom surface of the coupling part 420 of the sealing member 400, a latching part 450 supported by the stopper 220 in the process of the sealing member 400 being screw-coupled to the discharge part 210 is preferably provided.

The overcap 500 is coupled to encase the sealing member 400 to rotate the sealing member 400 together by a user's operation, and thereby, preventing the sealing member 400 from being detached from the discharge part 210.

At an inner circumferential surface of the overcap 500 is provided with a coupling groove 510 that is engaged with the guide protrusion 421 of the coupling part 420 to be able to be coupled to the sealing member 400.

Furthermore, at an inner circumferential surface of the overcap 500 the support protrusion 520 supported by a lower end of the detachment prevention protrusion 422 of the coupling part 420 to prevent the overcap 500 from being moved upward and disengaged from the coupled state is provided.

Hereinafter, the process of sealing the discharge hole 310 of the liquid contents discharge container according to an exemplary embodiment of the present invention will be described on reference to FIGS. 5 to 8.

Figure 5:
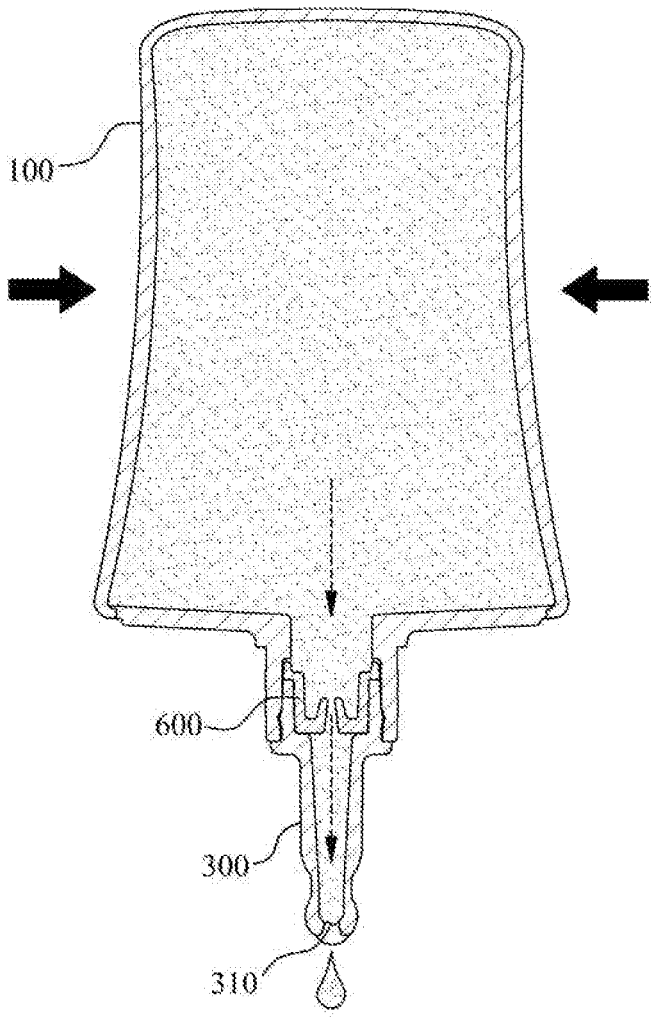
FIGS. 5 to 8 are explanatory drawings illustrating a process of sealing a discharge hole of a liquid contents discharge container according to an exemplary embodiment of the present disclosure.

First, as shown in FIG. 5, when the container body 100 is pressed, the liquid contents stored in the container body 100 pass through the discharge amount adjustment part 600 and the discharge is performed in the form of droplets through the discharge hole 310 of the contents discharge tube 300.

Figure 6:
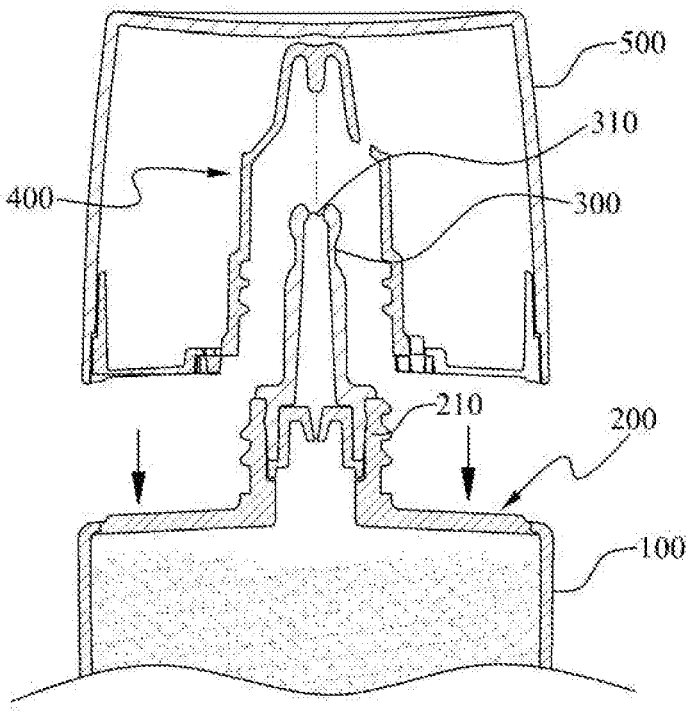
Figure 7:
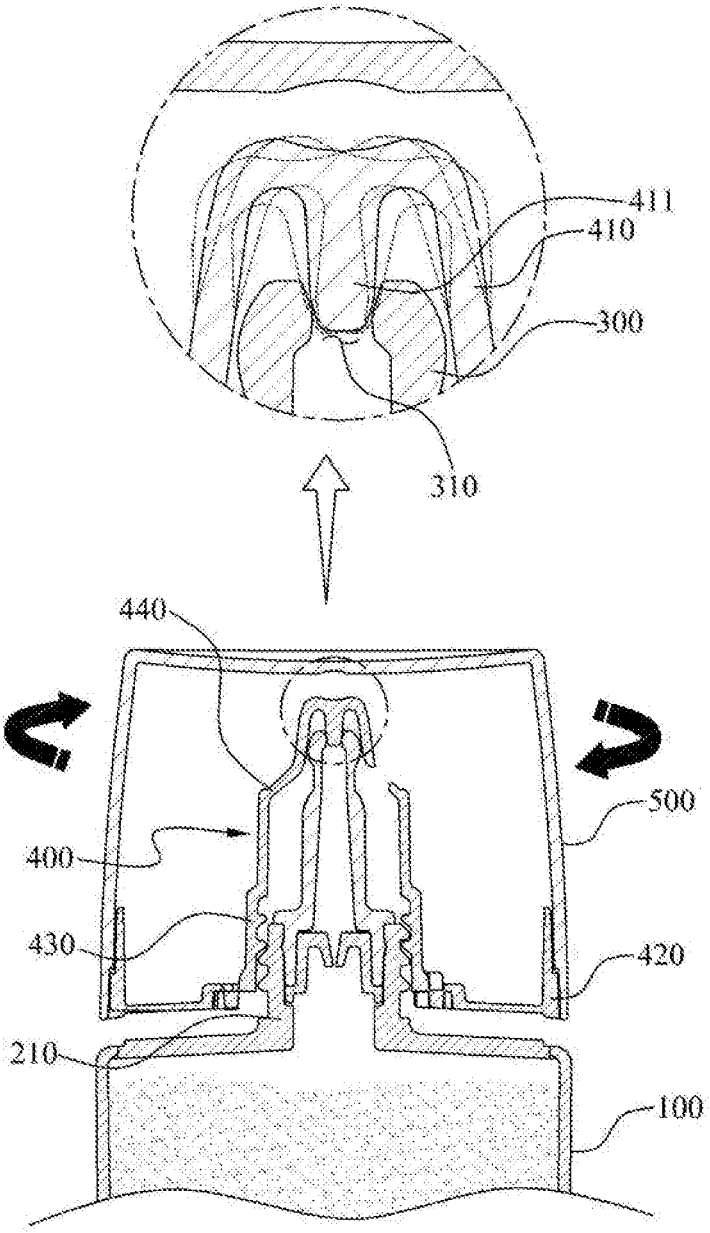

As described in the above, after the discharge of the contents is completed, as shown in FIGS. 6 and 7, the overcap 500 is placed on an upper portion of the container body 100 and when the overcap 500 is rotated in the closed direction, the sealing member 400 coupled to the inner side of the overcap 500 rotates together, and due to this, the coupling tube 430 of the sealing member 400 is screw-coupled to the discharge part and the sealing member 400 and the overcap 500 move downward.

At this time, the lower portion of the sealing projection 411 is made in contact with the upper end of the contents discharge tube 300 and is inserted to the discharge hole 310, and when the lower portion of the sealing projection 411 contacts the upper end of the contents discharge tube 300 angles of the sealing cap 410 and the sealing projection 411 are slightly changed by the tensioning of the elastic support bodies 440, thereby, even if the sealing protrusion 411 is not disposed directly above the discharge hole 310 according to the injection deviation or the assembly deviation of the contents discharge tube 300 and the sealing protrusion 411, thereby enabling the sealing protrusion 411 to be flexibly inserted to the discharge hole 310 of the contents discharge tube 300.

Figure 8:
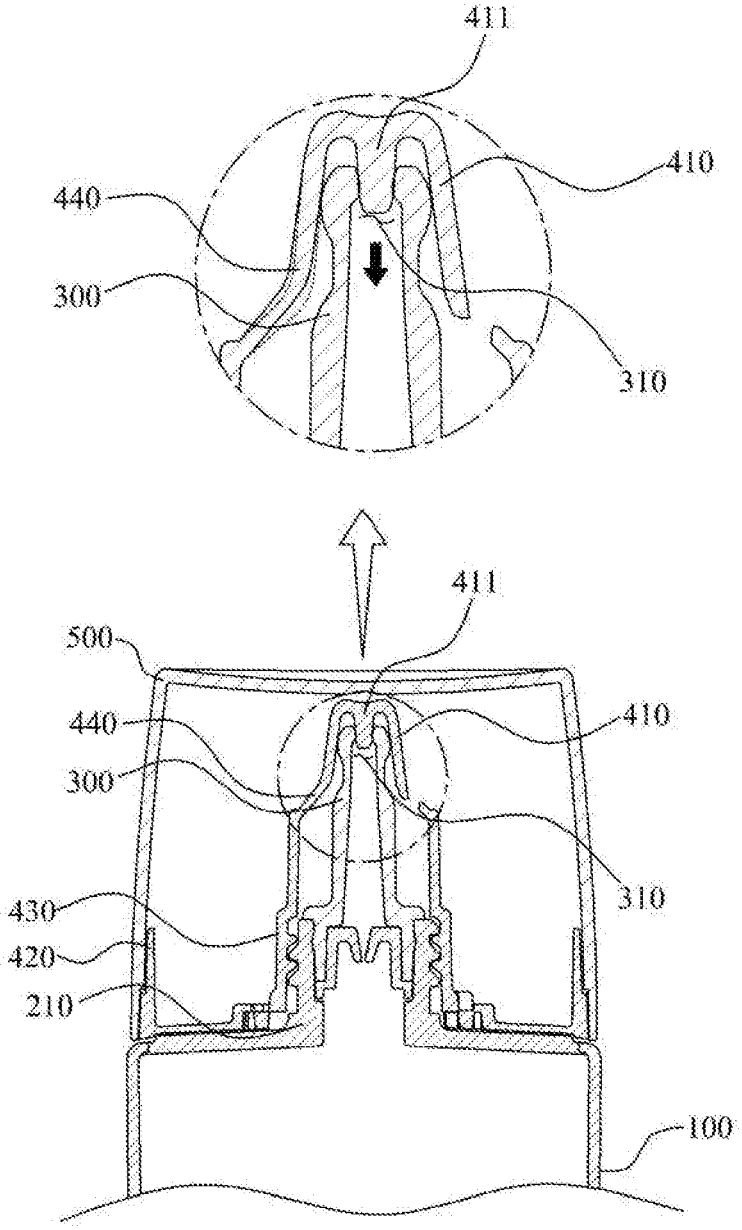

Meanwhile, as shown in FIG. 8, in a state in which the sealing projection 411 is inserted to the discharge hole 310 of the contents discharge tube 300, the elastic support bodies 440 slightly extends upwards, and at this time, the force of pulling the sealing cap 410 downward by the self-tensioning of the elastic support bodies 440 is generated, due to this, the sealing projection 411 is able to maintain a state more closely contacted to the inner wall of the contents discharge tube 300, thereby making it possible to provide an efficient sealing function.

The present invention, as described in the above, at an inner side of the overcap 500 the sealing member 400 provided with a sealing projection 411 to close the discharge hole 310 of the contents discharge tube 300 is coupled, wherein when the sealing member 400 is coupled to the discharge part 210 by rotating the overcap 500, the sealing protrusion 411 is configured to maintain a state more closely contacted to the inner wall of the contents discharge tube 300 by pulling the sealing cap 410 downward by the tensioning of the elastic support bodies 440, thereby making it possible to efficiently prevent leakage of the contents irrespective of the injection variation and the assembly variation of the contents discharge tube 300 and the sealing projection 411.

Optimal embodiments have been disclosed in the drawings and specification. Although specific terms have been used herein, they are only intended to describe the present disclosure and are not intended to limit the meanings of the terms or to restrict the scope of the present disclosure as disclosed in the accompanying claims. Therefore, those skilled in the art will appreciate that various modifications and other equivalent embodiments are possible from the above embodiments. Accordingly, the true technical protection scope of the present disclosure should be defined by the technical idea of the accompanying claims.

The invention claimed is:

1. A liquid contents discharge container, comprising: a container body storing contents;

a container neck disposed at an upper portion of the container body and provided with a discharge part for discharging the contents stored therein;

a contents discharge tube which is coupled to an upper portion of the discharge part and having a discharge hole formed at an upper end thereof for discharging contents to the outside;

a sealing member encasing the contents discharge tube and detachably coupled to the discharge part, and comprising a sealing cap provided with a sealing protrusion for sealing the discharge hole of the contents discharge tube when the sealing member is coupled to the discharge part; and an overcap coupled, encasing the sealing member to rotate the sealing member by a user's manipulation;

wherein the sealing member further comprises:

a coupling part coupled to the overcap so as to rotate the sealing member together with rotation of the overcap;

a coupling tube extending upward from a central portion of the coupling part and screw-coupled to the discharge part; and a plurality of elastic support bodies which are extended in a spaced apart at regular intervals from an upper portion of the coupling tube, and elastically support the sealing cap.

2. The liquid contents discharge container of claim 1, wherein, when the sealing member is coupled to the discharge part by rotating the overcap, an angle of the sealing cap is changed by the tensioning of the elastic support bodies, and the sealing protrusion is configured to be flexibly inserted into the discharge hole of the contents discharge tube.

3. The liquid contents discharge container of claim 1, wherein the sealing protrusion is configured to be closely contacted to an inner wall of the contents discharge tube by a force of pulling the sealing cap downward according to the tensioning of the elastic support bodies in a state inserted into the discharge hole of the contents discharge tube so as to provide a sealing function.

4. The liquid contents discharge container of claim 1, wherein at an outer circumferential surface of the coupling part is provided with a guide protrusion to guide coupling to the overcap, and at an inner circumferential surface of the overcap is provided with a coupling groove coupled to the guide protrusion.

5. The liquid contents discharge container of claim 1, wherein at an outer circumferential surface of the coupling part is provided with a detachment prevention protrusion so as to prevent the overcap from detaching due to movement thereof in an upward direction in the state in which the overcap is coupled, and at an inner circumferential surface of the overcap is provided with a support protrusion supported by a lower end of the detachment prevention protrusion.

6. The liquid contents discharge container of claim 1, further comprising, a discharge amount adjustment part provided with a discharge amount adjustment tube that becomes wider from a lower portion to an upper portion thereof so that discharge amount is adjusted when contents discharged through the discharge part move to the upper portion thereof.

* * * * *